US005927613A

United States Patent [19]

Koyanagi et al.

[11] Patent Number: 5,927,613

[45] Date of Patent: Jul. 27, 1999

[54] FUEL INJECTOR HAVING SIMPLIFIED PART SHAPE AND SIMPLIFIED ASSEMBLING PROCESS

[75] Inventors: Kazuaki Koyanagi; Takaaki Takagi, both of Obu, Japan

[73] Assignee: Aisan Kogyo Kabushiki Kaisha, Obu, Japan

[21] Appl. No.: 08/865,109

[22] Filed: May 29, 1997

[30] Foreign Application Priority Data

Jun. 3, 1996 [JP] Japan ..... 8-140025

[51] Int. Cl.[6] ..... B05B 1/30

[52] U.S. Cl. ..... 239/585.1; 239/585.4; 239/585.5; 251/129.21

[58] Field of Search ..... 239/583, 584, 239/585.1, 585.2, 585.4, 585.5; 251/129.21

[56] References Cited

U.S. PATENT DOCUMENTS 5,190,221 3/1993 Reiter ..... 239/463

5,400,970 3/1995 Alt et al. ..... 239/408

FOREIGN PATENT DOCUMENTS 2-66380 3/1990 Japan .

*Primary Examiner*—Andres Kashnikow
*Assistant Examiner*—Lisa Ann Douglas
*Attorney, Agent, or Firm*—Dennison, Meserole, Pollack & Scheiner

[57] ABSTRACT

A fuel injector includes a tubular core 3 which attracts an armature 10 of a valve 12 by energizing a solenoid coil 6, and an outside magnetic path forming member 7 which partly surrounds the solenoid coil 6 and which constitutes a magnetic path M together with an armature 10 and the core 3. The outside magnetic path forming member 7 is provided with an end plate 7*b* having a mounting hole 8, and the core 3 is provided with a flange 3*a* in contact with the end plate 7*b*. The core 3 is inserted into the mounting hole 8 of the outside magnetic path forming member 7 such that the end plate 7*b* comes into contact with the flange 3*a* of the core 3, thus readily positioning the outside magnetic path forming member 7 on the core 3.

5 Claims, 3 Drawing Sheets

FUEL INJECTOR HAVING SIMPLIFIED PART SHAPE AND SIMPLIFIED ASSEMBLING PROCESS

BACKGROUND OF THE INVENTION

1. Field of the Invention

This invention relates to an improvement of a fuel injector wherein the shape of a component part is simplified so that the part can be readily produced and assembled with high accuracy in a simple operation.

2. Description of the Prior Art

A conventional fuel injector is disclosed, for example, in Japanese Laid-Open Patent Publication No. 2-66380. This fuel injector will be described with reference to FIGS. 5 and 6 showing a vertical-sectional view thereof and a cross-sectional view taken along the line VI—VI of FIG. 5, respectively.

As shown in FIG. 5, a solenoid coil 103 is disposed on the lower periphery of a ferromagnetic metal tubular core 101. A ferromagnetic metal tubular connector 139 is connected via a ferromagnetic metal medium 106 to the lower end of the core 101. A tubular armature 112 is slidably disposed within the connector 139. The armature 112 is connected via a connecting tube 136 to a spherical valve 114. The connector 139 holds a valve seat 108 having an injection hole 117. The armature 112, the connecting tube 136 and the spherical valve 114 are attracted upward together by the solenoid coil 103 to thereby open the injection hole 117. The spherical valve 114 is biased in a closing direction by a return spring 118.

Outer peripheries of a part of the core 101 and the solenoid coil 103 are surrounded together by a plastic jacket 124. A pair of outside magnetic path forming members 128 made of ferromagnetic metal material are embedded in the jacket 124 while confronting each other as shown in FIG. 6.

As shown in FIG. 5, the outside magnetic path forming members 128 surround the solenoid coil 103, the core 101 and the connector 139 together. Each member 128 has such a complex shape as surrounding the solenoid coil 103, and has an axially extending end portion 132 in its upper part. The upper end portion 132 of the outside magnetic path forming member 128 is in contact with the core 101, while a lower end portion 132*a* thereof is in contact with the connector 139.

According to the conventional fuel injector, each of the paired outside magnetic path forming members 128 is fabricated by a band plate whose both ends are substantially bent into Z-shape. This construction makes the shape of the member 128 rather complicated, thus making it difficult to produce the members 128. Further, there is another problem in that the outside magnetic path forming members 128 should be fixed to the core 101 by welding or like operations after they are axially and circumferentially positioned in advance, thus making it complicated to assemble them.

SUMMARY OF THE INVENTION

Accordingly, an object of the present invention is to provide a construction in which an outside magnetic path forming member can be fixed to a core with high accuracy in a simple operation.

Another object of the present invention is to make simple a production process of the outside magnetic path forming member by simplifying the shape thereof.

A further object of the present invention is to reduce the assembling steps of the injector by reducing the number of the outside magnetic path forming members from conventionally required two pieces to one piece.

In a fuel injector of the present invention, the core is partly provided with a flange extending radially outwardly thereof. The outside magnetic path forming member is provided with an end plate of substantially disc-like shape having a bore with a diameter slightly smaller than that of the core. By inserting the core into the hole, the outside magnetic path forming member can be readily and accurately fixed to the core. By making a pair of extending portions extend from the end plate, the outside magnetic path forming member is easily produced from a single sheet material.

The present invention will be more fully understood from the following detailed description and appended claims when taken with the accompanying drawings.

DETAILED DESCRIPTION OF THE PREFERRED EMBODIMENT

Figure 1:
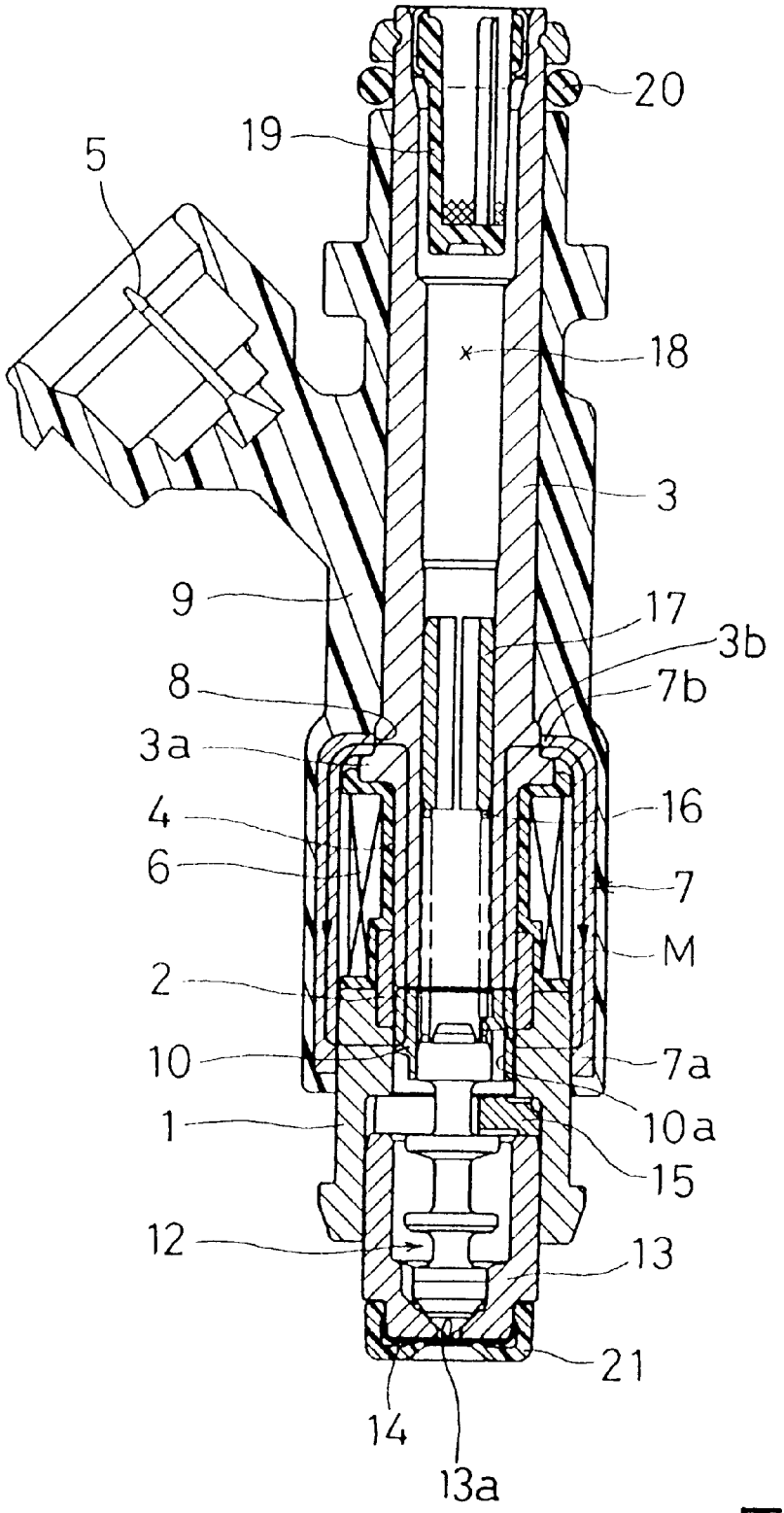
FIG. 1 is a longitudinal sectional view of a fuel injector according to an embodiment of the present invention.

Referring now to FIGS. 1 to 4, an embodiment of a fuel injector of the present invention will be described according to the order of assembling components. In FIG. 1 showing a longitudinal sectional view of a fuel injector to be used for a vehicle engine, an injector body 1 is formed of ferromagnetic material into a tubular shape. A non-magnetic ring 2 is welded into the upper end of the body 1 after press fitting. A ferromagnetic tubular core 3 has an end welded into an upper-half of the ring 2 after press fitting. Substantially in the center of the core 3 in its axial direction, a radially extending flange 3*a* is formed to position an outside magnetic path forming member 7 which will be described hereinafter. A portion 3*b* just above the flange 3*a* of the core 3 has an outer diameter slightly larger than a diameter of the rest part of the core 3.

Around the ring 2 and the core 3, a bobbin 4 made of synthetic resin or like electrically insulating materials is formed by plastic molding. The bobbin 4 has, on its upper end, a terminal connecting portion (not shown) to which a connecting end of a terminal 5 is press-fitted. A solenoid coil 6 is wound on the bobbin 4 and is electrically connected to the connecting end of the terminal 5.

Figure 2:
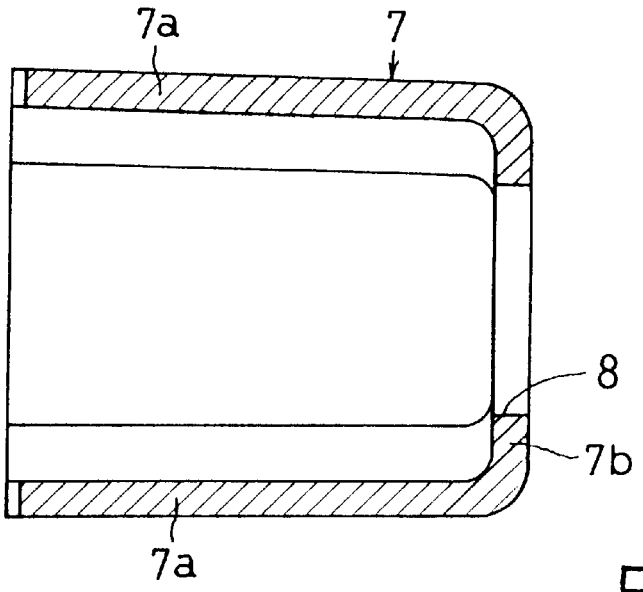
FIG. 2 is a sectional view of an outside magnetic path forming member.
Figure 3:
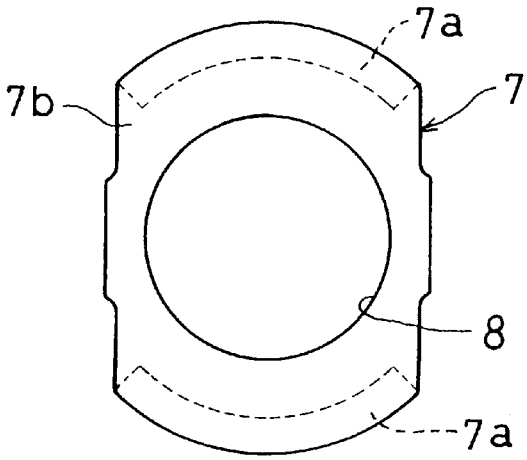
FIG. 3 is a right side view of the outside magnetic path forming member.
Figure 4:
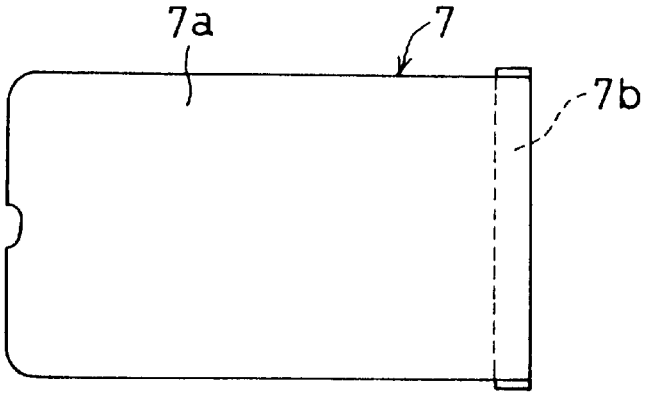
FIG. 4 is a bottom view of the outside magnetic path forming member.

A periphery of the solenoid coil 6 is partly surrounded by an outside magnetic path forming member 7 made of ferromagnetic metal material. FIG. 2 shows a sectional view of the outside magnetic path forming member 7, FIG. 3 shows a side view of FIG. 2, and FIG. 4 shows a bottom view of FIG. 2, respectively. As shown by these drawings, the outside magnetic path forming member 7 has a pair of extension pieces 7*a* each having an arcuate cross-section and circumferentially surrounding the solenoid coil 6 in part, and an end plate 7*b* having two ends each merging each end of the paired extension pieces 7*a*, and having a circular mounting hole 8 through which the core 3 is inserted. The diameter of the mounting hole 8 is slightly smaller than that of the portion 3*b* just above the flange 3*a* of the core 3. The paired extension pieces 7*a* extend from two portions of the end plate 7*b* diametically confronting each other. The outside magnetic path forming member 7 is integrally formed of a single sheet plate of ferromagnetic metal by deep-drawing. The mounting hole 8 of the end plate 7*b* is formed by punching.

As shown in FIG. 1, the outside magnetic path forming member 7 is assembled while it is positioned with respect to the core 3 by press-fitting the mounting hole 8 from upward to a periphery of the portion 3*b* just above the flange 3*a* and, at the same time, by axially bringing the end plate 7*b* into contact with the flange 3*a*.

By this assembling operation, the extension pieces 7*a* of the outside magnetic path forming member 7 are connected to the outside surface of the injector body 1 in a press-fitting manner.

Plastic-molding is performed to surround the area from an upper-half part of the body 1 to the upper end of the core 3. A connector 9 for the terminal 5 is formed as a part of the above plastic-molding. The connector 9 is connected to a feeding connector of an electronic controller (not shown). By receiving signals from the electronic controller, the solenoid coil 6 is energized or deenergized.

A tubular armature 10 is welded on an upper end of a shaft-like valve 12 after press-fitting, and is formed on its inside wall with a groove 10*a* as a fuel passage. The armature 10 is attracted to the core 3 when the solenoid coil 6 is energized.

A bottom closed cylindrical valve seat 13 having, through its bottom surface, an injection port 13*a* which is opened and closed by the valve 12 has a plate orifice 14 mounted on its outside bottom surface by laser welding. The plate orifice 14 is a circular plate with a plurality of injection holes (not numbered).

The valve 12 is inserted into the valve seat 13 after a U-shaped plate-like stopper 15 has been engaged with a neck formed on the valve 12. The valve seat 13 into which the valve 12 has been assembled is inserted into the body 1 and secured by caulking. By assembling the valve seat 13, the stopper 15 is interposed between a step portion of the injector body 1 and the upper surface of the valve seat 13. The valve 12 opens and closes the injection port 13*a* by axially sliding in the valve seat 13. The stopper 15 suppresses the retreat position (lifting position) of the valve 12.

A coil spring or a valve spring 16 is inserted into the core 3 and then a tube member or a spring pin 17 with a C-shaped cross section is press-fitted thereinto. The valve spring 16 biases the valve 12 normally in a valve closing direction. Loading of the valve spring 16 is adjusted by the positional adjustment of the spring pin 17.

A strainer 19 is press-fitted within the upper end portion of the core 3 corresponding to a fuel inlet of a fuel flow passage 18 formed from the upper end of the core 3 to the injection port 13*a* of the valve seat 13. When the connector 9 is plastic-molded, an annular recess (not numbered) is formed on an outside upper end of the core 3 so that an o-ring 20 is fitted thereon to serve for sealing the core 3 to a delivery pipe (not shown). A resin cap 21 for protection of the plate orifice 14 is fitted to cover an outer peripheral surface of a lower end portion of the valve seat 13.

One practical example of material for each essential component of the fuel injector will be shown below. Electromagnetic SUS is used for the injector body 1, SUS304 for the ring 2, electromagnetic SUS for the core 3, electromagnetic SUS for the outer magnetic path forming member 7, electromagnetic SUS for the armature 10, SUS440A for the stopper 15, SUS440C for the valve seat 13, and SUS304 for the plate orifice 14.

The operation of the fuel injector thus constructed will be described. Fuel supplied from a fuel tank (not shown) under a predetermined pressure is filtered by the strainer 19 and then passes through the fuel flow passage 18 and reaches the interior of the valve seat 13. However, the valve 12 is maintained in a condition that the injection port 13*a* of the valve seat 13 is closed by elasticity of the valve spring 16 so that fuel injection from the injection port 13*a* is not generated.

Here, when the solenoid coil 6 is energized by input of an electrical signal from the electronic controller, a magnetic path (see arrows M in FIG. 1) is constructed through the core 3, the armature 10, the injector body 1 and the outside magnetic path forming member 7. By an attraction force of core 3 produced in this way, the armature 10 and the valve 12 are retreated together. As a result, the valve 12 opens the injection port 13*a* of the valve seat 13 from which the fuel is injected. The injected fuel is further injected through the injection holes of the plate orifice 14. When the electric signal to the solenoid coil 6 becomes off to remove the attraction force which has acted on the armature 10, the valve 12 is again maintained in a condition that the injection port 13*a* is closed by elasticity of the valve spring 16. Thus, fuel injection from the injection port 13*a* is ceased.

According to the above-described fuel injector, the outside magnetic path forming member 7 is readily positioned relative to the core 3 by inserting the core 3 into the mounting hole 8 of the end plate 7*b* of the outside magnetic path forming member 7 and by bringing the end plate 7*b* into contact with the flange 3*a* of the core 3. Consequently, the positioning operation of the outside magnetic path forming member 7 with respect to the core 3 is simplified, thus improving assembling efficiency of the outside magnetic path forming member 7.

Figure 5:
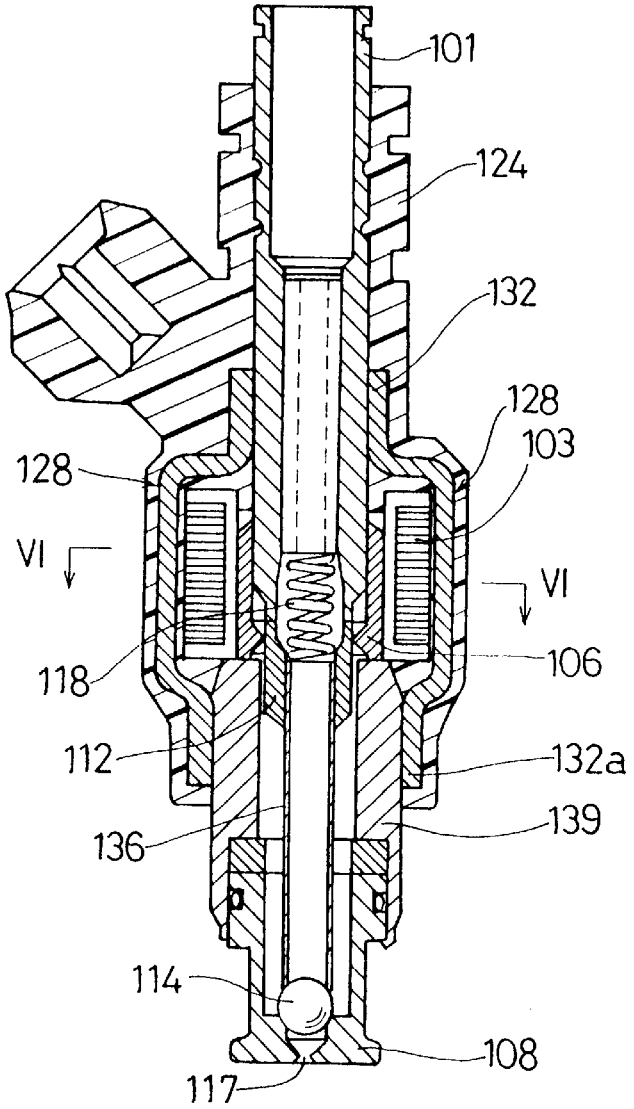
FIG.5 PRIOR ART
FIG. 5 is a longitudinal sectional view of a conventional fuel injector.
Figure 6:
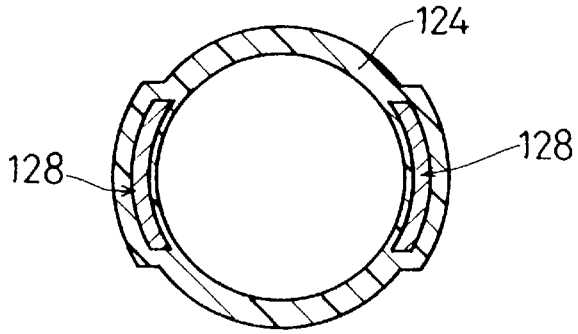
FIG.6 PRIOR ART
FIG. 6 is a cross-sectional view taken along line VI—VI of FIG. 5.

Further, both the extension pieces 7*a* having been connected by the end plate 7*b* need not be positioned and fixed in the circumferentially direction of the core 3. Further, the area of the magnetic path M can be increased since the flange 3*a* of the core 3 can be used as a part of the magnetic path M. Accordingly, it is not necessary to provide a connecting piece corresponding to each end portion 132, 132*a* (see FIG. 5) required for each conventional outside magnetic path forming member, thus simplifying the shape of the outside magnetic path forming member 7, and therefore simplifying the production thereof.

Further, by press-fitting the core 3 into the mounting hole 8 of the outside magnetic path forming member 7, positioning and fixing operations of the member 7 are simultaneously performed, thus further improving assembling efficiency of the outside magnetic path forming member 7.

Additionally, the outside magnetic path forming member is a product of such a simple molding as deep-drawing, thus being obtainable at low cost. The outside magnetic path forming member 7 has a simple shape in which straight extension pieces 7*a* and the plate-like end plate 7*b* are combined so that it can be molded by deep drawing. On the other hand, it is difficult to apply deep-draw molding to the complex shape of the conventional outside magnetic path forming member 128 (see FIG. 5).

The present invention is not limited to the above-described embodiment, and any modifications or variations may be easily made without departing from the scope of the present invention. For example, the core 3 may be fixed by welding instead of press-fitting, after it is inserted into the mounting hole 8 of the outside magnetic path forming member 7. The outside magnetic path forming member 7 can be formed by any fabrication processes and moldings other than deep-drawing. The number of the extension pieces 7*a* of the outside magnetic path forming member 7 is not limited to two.

According to the fuel injector of the present invention, the outside magnetic path forming member is simplified in positioning operation with respect to the core and is improved in assembling efficiency.

What is claimed is:

1. A fuel injector comprising:

a valve for opening and closing said fuel injector;

a substantially tubular solenoid coil for moving said valve;

a core passing through the interior of said solenoid coil; and an outside magnetic path forming member positioned outside said solenoid coil;

said core having a radially outwardly extending flange formed at one portion of an axial direction of said core; and said outside magnetic path forming member having a substantially disc-like end plate at the center of which a hole is formed for receiving said core without producing a gap between said disc-like end plate and said core, said end plate being in contact with the flange.

2. The fuel injector as defined in claim 1, wherein said outside magnetic path forming member further has a pair of extension pieces extending from two diametrically confronting portions of said end plate.

3. The fuel injector as defined in claim 2, wherein said outside magnetic path forming member is formed of a single sheet of ferromagnetic metal material by deep-drawing.

4. The fuel injector as defined in claim 2, wherein said outside magnetic path forming member is fixed by being press-fitted into said core.

5. The fuel injector as defined in claim 2, wherein each of said paired extension pieces is in close contact with the periphery of said solenoid coil.

* * * * *